US005352174A

United States Patent [19]

Mason et al.

[11] Patent Number: 5,352,174

[45] Date of Patent: Oct. 4, 1994

[54] SHOULDER EXERCISE SYSTEM

[75] Inventors: Bradley R. Mason, Olivenhain; Jeffrey T. Mason, Escondido, both of Calif.

[73] Assignee: Breg, Inc., Vista, Calif.

[21] Appl. No.: 736,393

[22] Filed: Jul. 26, 1991

[51] Int. Cl.[5] ..... A63B 21/02

[52] U.S. Cl. ..... 482/129; 482/904

[58] Field of Search ..... 482/121, 122, 124, 125, 482/126, 127, 129, 131, 904

[56] References Cited

U.S. PATENT DOCUMENTS

| | | | |
|---|---|---|---|
| 3,655,185 | 4/1972 | Kane | 482/125 |
| 3,814,084 | 5/1973 | Gustafson | 482/131 |
| 3,966,204 | 6/1976 | Dubach | 272/135 |
| 3,979,114 | 10/1976 | Codina | 272/126 |
| 4,023,808 | 1/1976 | Hebert | 482/126 |
| 4,060,240 | 11/1977 | Dunston | 482/131 |
| 4,079,933 | 3/1978 | Everroad | 272/121 |
| 4,251,071 | 2/1981 | Norton | 272/137 |
| 4,440,391 | 9/1982 | Saenz, Jr. et al. | 482/148 |
| 4,685,671 | 8/1987 | Hagerman | 272/139 |
| 4,700,945 | 10/1987 | Rader | 272/127 |
| 4,722,523 | 2/1988 | Yang | 272/122 |
| 4,733,861 | 3/1988 | Plunkett | 482/126 |
| 4,909,505 | 3/1990 | Tee | 272/136 |
| 4,974,836 | 12/1990 | Hirsch | 272/117 |

*Primary Examiner*—Gene Mancene
*Assistant Examiner*—Jeffrey A. Smith
*Attorney, Agent, or Firm*—Rodney F. Brown

[57] ABSTRACT

A system utilizable by a patient engaged in strengthening, stretching or range of motion exercise therapy of the shoulder which contains a number of interactive components combinable in any one of several different configurations to provide the patient with specific shoulder exercise devices. A first device provides shoulder exercise by moving the patient's arm in various directions against the elastic resistance of an elastomeric tube while the device is anchored to the foot of the patient or in a door jamb. A second device provides shoulder exercise by grasping opposite ends of an overhead line resting on a support guide anchored in a door jamb and pulling the opposite ends of the line back and forth across the glide. A third device provides shoulder exercise by performing various movements of the arms while grasping opposite ends of a baton assembly.

3 Claims, 3 Drawing Sheets

SHOULDER EXERCISE SYSTEM

FIELD OF THE INVENTION

The present invention relates generally to shoulder exercise. More particularly, the present invention relates to a multi-component system for therapeutically exercising the shoulder. The present invention particularly, though not exclusively, relates to a multi-component system for therapeutically exercising the shoulder wherein the components of the system are interchangeable to provide several different shoulder exercise devices.

BACKGROUND OF THE INVENTION

Rehabilitation of the shoulder joint following skeletal or soft tissue injuries is facilitated by a structured and supervised strengthening, stretching, and range of motion exercise program. Rehabilitation is most effective when the exercise program can be periodically performed by the patient on a frequent basis, even as much as several times daily. Patient participation in the exercise program is usually increased if the patient can perform the exercises within the framework of his or her daily activities without the necessity of traveling to a special facility for ongoing supervision or specialized equipment. Thus, exercise programs are desirable which can be performed in the home or the workplace with safe, simple, and inexpensive equipment once the supervising physician or therapist has adequately structured and demonstrated the exercise program to the patient.

A number of devices are known which may be utilized in the performance of shoulder rehabilitation exercises. Most prior art devices, however, suffer from the fact that they are narrow in their purpose, only providing for exercise of a limited number of muscle groups related to the shoulder. They lack the versatility to provide the full range of shoulder exercises necessary for a patient undergoing rehabilitation from a shoulder injury.

As such, a need exists for a shoulder exercise system which has the versatility to enable a patient to perform a broad range of shoulder exercises for full rehabilitation of an injured shoulder without the necessity for constant medical supervision once a physician or therapist has initially structured the exercise program. A system is further needed which is portable for ease of transportation and use in remote locations. A system is needed which is simple to assemble as well as simple and safe to use by the patient. Finally, a system is needed which fulfills the above-recited needs, yet which is relatively inexpensive to produce and maintain.

SUMMARY OF THE INVENTION

The present invention is a system utilizable by a patient engaged in strengthening, stretching or range of motion exercise therapy of the shoulder as well as members of the body ancillary to the shoulder. The system contains a number of components which are combinable in any one of many interchangeable configurations to provide the patient with several specific shoulder exercise devices.

One such device for shoulder exercise includes an elastomeric tubing loop selected from a set of interchangeable tubing loops, each having a different modulus of elasticity of elongation corresponding to different required levels of effort for the performance of exercise. Each tubing loop has a handle integral therewith which is graspable by the patient. The device also includes a door strap loop removably connectable to the tubing loop by a loop connector clip. The door strap loop has a stop which may be used to anchor the device.

The device is used by initially anchoring the door strap loop to a stationary structure. Such a structure can be the foot of the patient or a door and associated door jamb. Where the foot is the relevant stationary structure, the door strap loop is placed around the foot and anchored in place by the weight of the patient standing thereon. Where the door and door jamb are the relevant stationary structure, the door strap loop is positioned between the door and door jamb at a preselected position relative to the shoulder height of the patient and the door is shut. The preselected position may be at a height above the shoulder, a height below the shoulder, or a height even with the shoulder. When the door is closed with the door strap loop at the desired position, the door anchors the door strap loop by wedging the stop against the closed door and door jamb on one side of the door. The patient performs shoulder exercises by grasping the tubing loop handle with one hand and moving the arm against the elastic resistance of the tubing loop through various prescribed ranges of motion alternately away from and toward the body with the elbow in either a flexed or extended condition.

A second shoulder exercise device of the present system employs the door strap loop and loop connector clip of the above-described device in conjunction with a flexible line and support guide. The support guide is anchored at a point along the line to slidably retain the line so that it can be drawn back and forth across the guide. Anchoring of the support guide is provided by connecting it to the door strap loop via the loop connector clip.

When using the device, the door strap loop is positioned between the door jamb and closed door above the patient so that the support guide connected thereto is likewise positioned above the patient. While sitting or standing beneath the support guide, the patient grasps the two handles fixed at the ends of the line in opposite hands. The patient then alternately moves the handles in opposing directions while the arms are in one of several different prescribed orientations relative to the body and the elbows flexed or extended. Thus, while the line draws one arm down, the line draws the opposite arm upward to exercise the shoulder.

The present shoulder exercise system further includes a third shoulder exercise device which comprises a baton assembly having handles at opposite ends thereof. The assembly is made up of a plurality of baton segments having correspondingly threaded ends which when joined form the unitary assembly. In use the baton handles are grasped in opposite hands by the patient and a series of prescribed repetitive arm motions are performed by the patient while the hands continuously grasp their respective handles.

A carrying bag is provided to hold all of the components of the system such that the system is rendered self-contained and portable. This enables the patient to conduct an exercise therapy program at locations remote from the supervising physician or therapist with a minimum of disruption to his or her daily activities. The system is particularly applicable to the rehabilitation of soft tissue injuries to the shoulder, such as those types of shoulder injuries frequently associated with athletic activities. The system is further applicable to the exercise of healthy shoulders. An exercise manual may be provided with the system for containment in the carrying bag which outlines a specific exercise regimen prescribed to the patient by the supervising physician or therapist and showing the exercise procedures for the patient to follow.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

Figure 1:
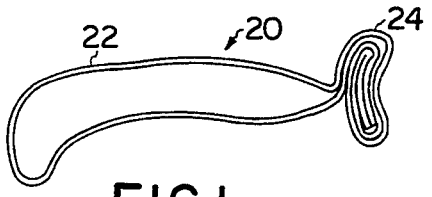
FIG. 1 is a plan view of a door strap loop included in the system of the present invention.

FIGS. 1–5 show a plurality of interactive components utilizable in the shoulder therapy system of the present invention which are combinable in different configurations and combinations to form devices for therapeutically exercising the shoulder of a patient. Referring initially to FIG. 1, a door strap loop designated generally as 20 is shown comprising a continuous loop 22 formed from a flexible strap which is relatively inelastic. A preferred material for loop 22 is a high-strength synthetic fabric. Appended to loop 22 is a door jamb stop 24 which is preferably formed from the same strap material as loop 22. Stop 24 is preferably integral with loop 22, formed by balling up excess strap extending from loop 22 and securing it thereto.

Figure 2:
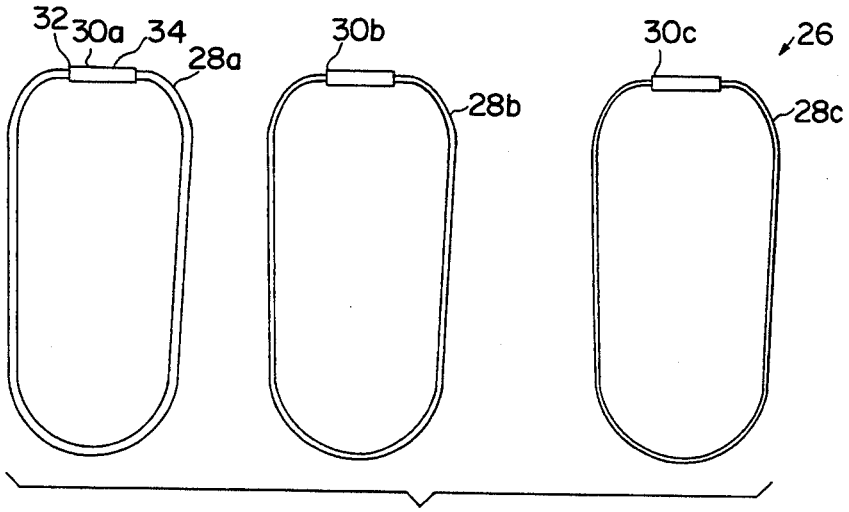
FIG. 2 is a plan view of a tubing loop set included in the system of the present invention.

FIG. 2 shows a set of elastomeric tubing loops designated generally as 26. Set 26 may contain any number of tubing loops 28 and as shown here comprises three tubing loops 28*a*, 28*b*, 28*c* which are flexible and sufficiently elastic to enable substantial stretching thereof under an arm or shoulder force provided by the patient. Each tubing loop 28*a*, 28*b*, 28*c* has a handle 30*a*, 30*b*, 30*c* integral therewith. Handle 30 is a rigid tubular member 32 formed from a molded plastic and having an outer foam layer 34 to cushion the grip of a patient. Handle 30 circumscribes a portion of tubing loop 28 and is fixably and substantially permanently positioned thereon. Each tubing loop 28*a*, 28*b*, 28*c* further has a different modulus of elasticity of elongation corresponding to different required levels of effort for stretching the respective tubing loops. Tubing loops 28*a*, 28*b*, 28*c* may further have different colors to provide rapid color-coded identification of the their different moduli of elasticity.

Figure 3:
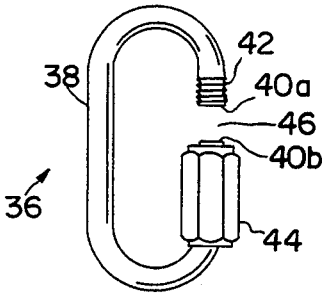
FIG. 3 is a side view of a loop connector clip included in the system of the present invention.

FIG. 3 shows a loop connector clip 36 in an open position. Clip 36 has a c-shaped member 38 having male threads at each end 40*a*, 40*b*. (Only threads 42 are shown.) A hexagonal nut 44 having internal female threads compatible with male threads 42 is threaded onto end 40*b* of member 38 to maintain a gap 46 in member 38. Clip 36 is preferably fabricated from a rigid material such as a strong lightweight metal. When it is desired to convert clip 36 to a closed position and thereby secure loop connector clip 36 to another loop component such as tubing loop 28, the component is looped through gap 46 and over member 38. Nut 44 is then threaded onto threads 42 of end 40*a* to close gap 46 in member 38 and secure the loop component therein.

Figure 4:
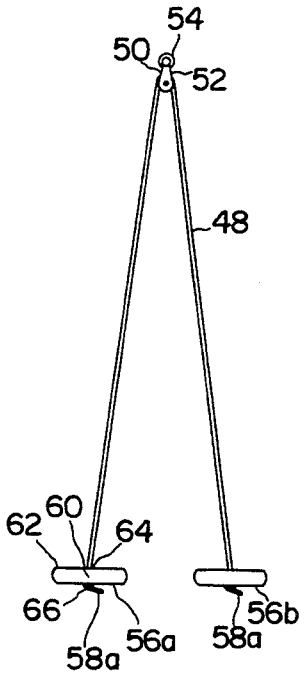
FIG. 4 is a plan view of a line and corresponding support guide included in the system of the present invention.

FIG. 4 shows a flexible line 48 and an associated support guide 50. Support guide 50 is a conventional pulley 52 on which line 48 is slidably mounted. Integral with pulley 52 is a connector loop 54 attachable to loop connector clip 36. Guide 50 is formed from a strong rigid material such as a metal. Line 48 is a thin flexible rope which is substantially inelastic relative to tubing loop 30. Handles 56*a*, 56*b* are provided at opposite ends 58*a*, 58*b* of line 48. Handle 56 is a rigid tubular member 60 formed from a molded plastic and having an outer foam layer 62 to cushion the grip of a patient. A bore 64 is formed through handle 56 through which end 58 is threaded. A knot 66 is formed in end 58 to retain handle 56 on line 48.

Figure 5:
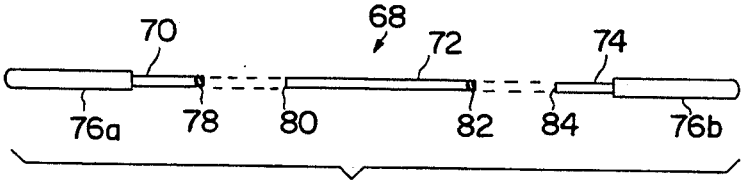
FIG. 5 is a plan view of a disassembled baton assembly included in the system of the present invention.

A baton assembly 68 is shown in FIG. 5 in a disassembled condition. Reassembly of baton assembly 68 follows the dashed lines. Baton assembly 68 has three segments 70, 72, 74 which when combined form the unitary assembly 68. Each segment 70, 72, 74 is a tube-shaped member formed from a strong, relatively inelastic material such as polyvinyl chloride piping. End segments 70, 74 have foam handles 76*a*, 76*b* to cushion the grip of a patient. Segments 70, 72, 74 are joined at threaded couplings. Thus, male threads 78 are provided on end segment 70 to be received by female threads 80 in middle segment 72. Similarly male threads 82 are provided on middle segment 72 to be received by female threads 84 of end segment 74.

Figure 6:
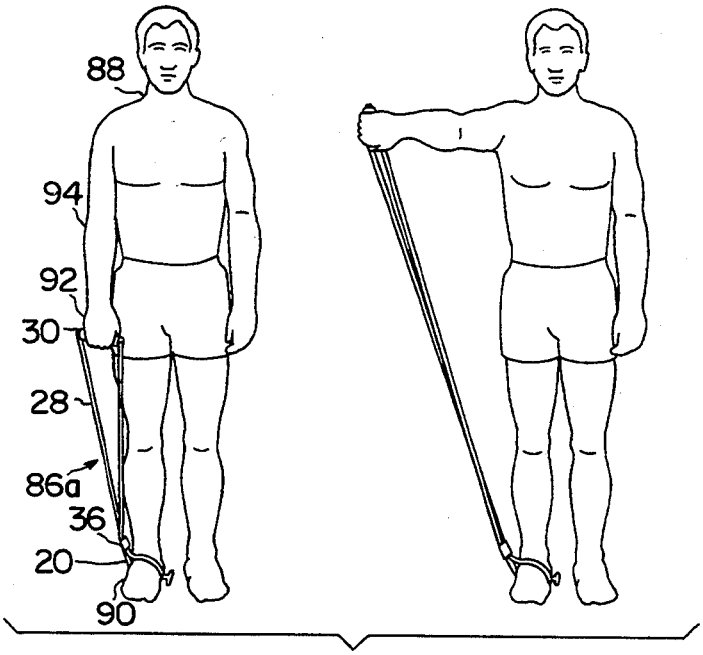
FIG. 6 is a perspective view of a first shoulder exercise device of the present system as used by a patient.

FIGS. 6–10 show several shoulder exercise devices formed from combinations of the components of the present system and representative methods for using the devices. Referring initially to FIG. 6, a first shoulder exercise device designated generally as 86*a* is shown in use by the patient 88. Device 86*a* comprises elastomeric tubing 28 preselected from set 26 according to the desired level of exercise. Door strap loop 20 is connected to tubing loop 28 by loop connector clip 36. Door strap loop 20 is placed around the ball of patient's foot 90 and held in place by the weight of patient 88. Handle 30 is then gripped with hand 92 and arm 94 is moved away from the body against the elastic resistance of tubing loop 28. FIG. 6 shows one type of shoulder exercise performed using device 86*a* wherein arm 94 is raised by patient 88 from the side and returned to the side in as many repetitions as desired. Other similar exercises may be performed using device 86*a* which contribute to a comprehensive shoulder exercise program as is apparent to one skilled in the art.

Figure 7:
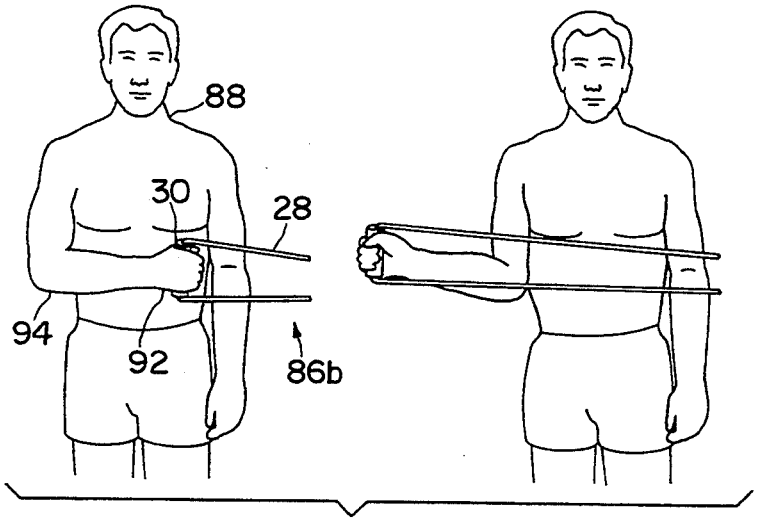
FIG. 7 is a perspective view of another embodiment of the first shoulder exercise device as used by a patient.
Figure 8:
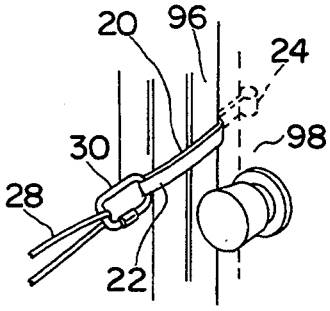
FIG. 8 is a perspective view of an anchored door strap loop as used in the embodiment of FIG. 7.

FIG. 7 shows a second embodiment of the first shoulder exercise device which is designated generally as 86*b*. Device 86*b* has identical components as device 86*a*, but unlike device 86*a*, is anchored remotely from patient 88. Device 86*b* is anchored as shown in FIG. 8 by holding door strap loop 20 in place between a door jamb 96 and a closed door 98. Loop 22 is shown on one side of the closed door 98 and stop 24 is shown in phantom on the opposite side of door 98. Loop connector clip 36 is looped through loop 22 and tubing loop 28 to provide a connection between door strap loop 20 and tubing loop 28. Stop 24 and loop 22 are sized such that when loop 22 is positioned in door jamb 96, door 98 may be closed without interference from loop 22. However, with stop 24 positioned on one side of closed door 98 and a portion of loop 22 extending from the other side of closed door 98, stop 24 is sufficiently large to resist being drawn between closed door 98 and jamb 96 when a force is applied to loop 22 away from closed door 98.

Returning to FIG. 7, it is seen that with tubing loop 28 connected to anchored door strap loop 20 (shown in FIG. 8), a plurality of shoulder exercises can be performed by the patient 88 while moving arm 94 with handle 30 grasped in hand 92. One such exercise as shown in FIG. 7 is the pivoting of arm 94 back and forth away from and toward the body at the elbow while the upper arm is maintained substantially stationary against the body and the elbow is maintained bent at a 90° angle. The exercise is repeated as many times as desired. It is noted that the exercise of FIG. 7 is performed with door strap loop 20 anchored on the side of door 98 such that door strap loop 20 is positioned at or near the height of the shoulder. For variations of exercise, door strap loop 20 is alternatively positionable at the top or bottom of door 98. Stop 24 may not be sufficiently large to anchor door strap loop 20 in a larger crack typically found at the bottom of a door, in which case baton segment 72 can be slipped through loop 22 on the opposite side of the door from tubing loop 28 to provide a larger stop for door strap loop 20.

Figure 9:
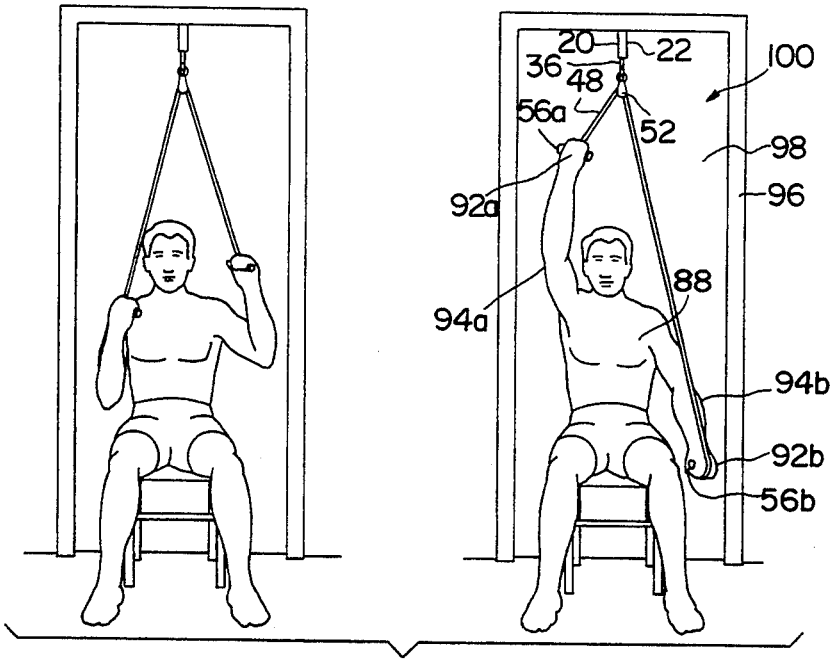
FIG. 9 is a perspective view of a second shoulder exercise device of the present system as used by a patient.

FIG. 9 shows a second shoulder exercise device designated generally as 100 and comprising line 48 and support guide 50 in combination connected to door strap loop 20 by loop connector clip 36. Door strap loop 20 is anchored between door jamb 96 and door 98 substantially overhead of patient 88 such that loop 22 protrudes from the top of door 98. Support guide 50 is correspondingly positioned at a height above the shoulders of the patient 88. An exemplary shoulder exercise using device 100 is performed by grasping handles 56*a*, 56*b* in each hand 92*a*, 92*b* and pulling down on line 48 with arm 94*b* while raising the opposite arm 94*a*. This motion is then reversed to return device 100 to its original position. As many repetitions of the exercise as desired may be performed. Pulley 52 enables line 48 to slide back and forth across support guide 50 with minimal resistance.

Figure 10:
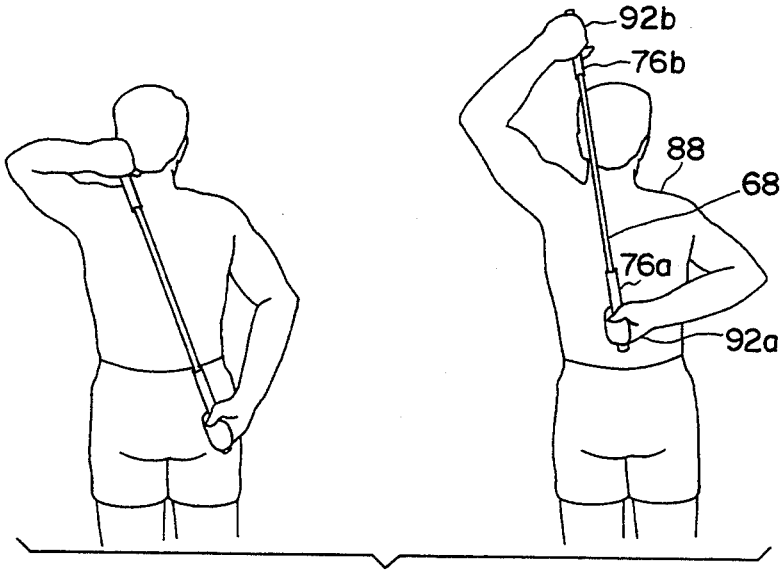
FIG. 10 is a perspective view of a third shoulder exercise device of the present system as used by a patient.

FIG. 10 shows baton assembly 68 in use by patient 88. With hands 92*a*, 92*b* grasping handles 76*a*, 76*b* respectively to maintain continuous contact therewith, assembly 68 is worked by the arms in various range of motion exercises in front of, beside, or behind the body. As shown by way of example, the baton assembly 68 is worked up and down by patient 88 behind the back, thereby exercising a shoulder.

Figure 11:
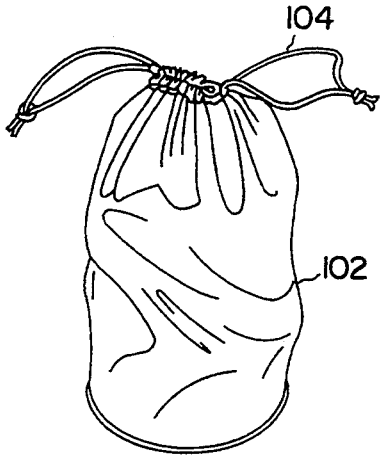
FIG. 11 is a perspective view of a bag for retaining the system of the present invention.

A carrying bag 102 is shown in FIG. 11 which is provided to hold the disassembled components of the system. Bag 102 is preferably fabricated from a strong lightweight material such as a synthetic cloth and is provided with a drawstring 104 to retain its contents.

It is understood that although the present system has been described above for therapeutic exercise rehabilitation of the shoulder, the present invention can likewise be utilized in a similar manner to exercise healthy shoulders. It is further understood that while the particular Shoulder Exercise System as herein shown and disclosed in detail is fully capable of obtaining the objects and providing the advantages hereinbefore stated, the particular system shown is merely illustrative of the presently preferred embodiments of the invention and that no limitations are intended to the details of construction or design herein shown other than as described in the appended claims.

We claim:

1. A shoulder exercise system having a plurality of interactive components combinable in a shoulder exercise device for strengthening, stretching or range of motion exercise for the shoulder of a user, said shoulder exercise system comprising:

a door strap loop having a stop appended thereto, said door strap loop and stop integrally formed from a flexible strap, wherein a portion of said door strap loop has a profile with a first thickness enabling said portion to be fixably positionable within a union between a door jamb and a closed door while the remainder of said door strap loop is extendable from one side of said union, and further wherein said stop has a profile with a second thickness greater than said first thickness such that said stop is too thick to be positionable in said union, but is extendable from the opposite side of said union, said second thickness defined by a secured balled up configuration of said strap;

a first continuous elastomeric tubing loop having a substantially rigid handle positioned on said continuous tubing loop; and a releasable loop connector means for connecting said door strap loop and said tubing loop by simultaneous engagement of said loop connector means with said door strap loop and said tubing loop to provide a first shoulder exercise device.

2. A shoulder exercise system as recited in claim 1 wherein said releasable loop connector means comprises a curved member having two ends and an opening therebetween, and further wherein said releasable loop connector means comprises a closure releasably engagable with said two ends to selectively close said opening.

3. A shoulder exercise system as recited in claim 2 wherein at least one of said curved member ends is provided with threads and said closure is provided with corresponding threads enabling threadable engagement between said at least one end and said closure.

* * * * *